US011274005B2

(12) United States Patent
Kusumi

(10) Patent No.: US 11,274,005 B2
(45) Date of Patent: Mar. 15, 2022

(54) SHEET CONVEYANCE DEVICE AND METHOD FOR CONTROLLING SHEET CONVEYANCE DEVICE

(71) Applicant: KYOCERA Document Solutions Inc., Osaka (JP)

(72) Inventor: Tadaharu Kusumi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 135 days.

(21) Appl. No.: 15/930,271

(22) Filed: May 12, 2020

(65) Prior Publication Data

US 2020/0361730 A1 Nov. 19, 2020

(30) Foreign Application Priority Data

May 14, 2019 (JP) ..... JP2019-091346

(51) Int. Cl.

*B65H 7/12* (2006.01)
*B65H 3/06* (2006.01)
*B65H 7/02* (2006.01)

(52) U.S. Cl.

CPC ..... *B65H 7/125* (2013.01); *B65H 3/0669* (2013.01); *B65H 7/02* (2013.01); *B65H 2511/524* (2013.01); *B65H 2515/702* (2013.01); *B65H 2553/30* (2013.01)

(58) Field of Classification Search

CPC ... B65H 3/06; B65H 7/00; B65H 7/02; B65H 7/12; B65H 7/125; B65H 2511/13; B65H 2511/524; B65H 2515/702; B65H 2553/30

See application file for complete search history.

(56) References Cited

U.S. PATENT DOCUMENTS

2004/0150155 A1* 8/2004 Okitsu ..... B65H 7/125 271/262
2017/0341890 A1 11/2017 Hayashi et al. ..... B65H 7/04
2019/0248611 A1* 8/2019 Okazaki ..... G01N 29/4427
2019/0265374 A1* 8/2019 Arai ..... B06B 1/0207

FOREIGN PATENT DOCUMENTS

JP 2017-210349 A 11/2017

* cited by examiner

*Primary Examiner* — Prasad V Gokhale

(74) *Attorney, Agent, or Firm* — Stein IP, LLC

(57) ABSTRACT

A sheet conveyance device includes a transmitter circuit, a receiver circuit, an integrator circuit which performs charging of electric charge outputted from the transmitter circuit and outputs a judgment voltage, a drive circuit, and a control circuit. The drive circuit feeds a drive signal to the transmitter circuit. At a lapse of a wait time after changing a level of a transmission instruction signal to a level instructing to feed the drive signal to the transmitter circuit, the control circuit makes the integrator circuit start to perform charging. When adjusting the wait time, the control circuit performs processing for adjustment a plurality of times. The control circuit makes the wait time different in each execution of the processing for adjustment. The control circuit determines a new wait time based on a magnitude of the judgment voltage recognized in each execution of the processing for adjustment.

8 Claims, 7 Drawing Sheets

SHEET CONVEYANCE DEVICE AND METHOD FOR CONTROLLING SHEET CONVEYANCE DEVICE

This application is based upon and claims the benefit of priority from the corresponding Japanese Patent Application No. 2019-091346 filed on May 14, 2019, the entire contents of which are incorporated herein by reference.

BACKGROUND

The present disclosure relates to a sheet conveyance device which conveys a sheet such as a document sheet.

There are devices that convey a sheet to perform a job. Examples of such devices include document-sheet conveyance devices and image forming apparatuses. In a sheet conveyance device, multiple feeding may occur in which two or more sheets are conveyed together in an overlapping state. Multiple feeding of sheets can cause a jam (a sheet jam) and an error. To prevent a jam and error, a sheet conveyance device may detect multiple feeding. To detect multiple feeding, an ultrasonic sensor may be used. There is known a device that detects multiple feeding by using an ultrasonic sensor as described below.

Specifically, a sheet conveyance device includes an emission unit provided on a conveyance path to face a first face of a sheet and configured to emit ultrasonic waves and a receiver unit provided on the conveyance path to face a second face of the sheet, the first and second faces of the sheet being opposite sides of the sheet, and configured to receive the ultrasonic waves, a measurement unit which measures receiving intensity which is the intensity of the ultrasonic waves received by the receiver unit, and a judgment unit which judges the conveyance state of the sheet based on the measured receiving intensity. The judgment unit makes a judgment on the conveyance state based on the receiving intensity measured in each of a plurality of periods after the emission of ultrasonic waves. The plurality of periods are a first period during which the receiver unit receives direct waves which are components of ultrasonic waves emitted from the emission unit to pass through a sheet present in a region to reach the receiver unit, and a second period during which the receiver unit does not receive direct waves but receives diffracted waves which are components of ultrasonic waves that bypass a second sheet to reach the receiver unit.

The ultrasonic sensor includes a transmitter circuit and a receiver circuit. The transmitter circuit transmits ultrasonic waves. The receiver circuit receives ultrasonic waves. The stronger the received ultrasonic waves are, the larger the output voltage (the amplitude) of the receiver circuit becomes. This characteristic is made use of to detect multiple feeding. Specifically, in accordance with the number of sheets present between the transmitter circuit and the receiver circuit, the output of the receiver circuit varies stepwise. The larger the number of sheets present between the transmitter circuit and the receiver circuit is, the lower the output voltage of the receiver circuit becomes. Based on the level of the output voltage, a judgment is made on whether one sheet is conveyed or a plurality of sheets are conveyed together (multiple feeding).

Here, a piezoelectric element may be used as an element for receiving. On receiving a vibration (pressure) caused by ultrasonic waves, the output voltage of the piezoelectric element vibrates. In this configuration, a charging circuit may be used to perform charging of the output of the receiver circuit for a certain period of time. The charging circuit accumulates electric charge outputted from the receiver circuit. A larger voltage is outputted as a larger amount of electric charge is accumulated. In this case, the output voltage of the charging circuit can be used to judge whether or not multiple feeding has occurred.

Conventionally, time from when ultrasonic waves are transmitted until when charging is started is fixed. The time from when ultrasonic waves are transmitted until when charging is started is set in advance. Here, to minimize influence from noise, time during which to continue charging is also determined in advance. The charging time is preferably set so as to include a peak of the output of the receiver circuit. With the peak excluded, the maximum value of the voltage outputted from the charging circuit becomes small. In this case, the range of voltage (the width of voltage) used for the judgment becomes substantially narrow. Conventionally, the time from when ultrasonic waves are transmitted until when charging is started is fixed. As a result, with influences from factors such as an installation error (displacement, tolerance) and temperature, correct detection of multiple feeding may disadvantageously be prevented.

In the known sheet conveyance device mentioned above, distance deviation between the transmitter circuit and the receiver circuit is not considered. Accordingly, with the known sheet conveyance device mentioned above, the above problem cannot be solved.

SUMMARY

To achieve the above object, according to an aspect of the present disclosure, a sheet conveyance device includes a sheet feed rotary body, a transmitter circuit, a receiver circuit, an integrator circuit, a drive circuit, and a control circuit. The sheet feed rotary body feeds out a sheet. The transmitter circuit is provided on a conveyance path for the sheet fed out by the sheet feed rotary body, and transmits ultrasonic waves. The receiver circuit is provided on the conveyance path for the sheet. The receiver circuit outputs an electric charge in accordance with intensity (strength) of the ultrasonic waves received. The integrator circuit performs charging of electric charge outputted from the receiver circuit. The integrator circuit outputs a judgment voltage having a magnitude in accordance with an amount of electric charge charged. The drive circuit feeds the transmitter circuit with a drive signal for having the ultrasonic waves transmitted. The control circuit judges, based on the magnitude of the judgment voltage, whether or not multiple feeding has occurred. The transmitter circuit and the receiver circuit are arranged opposite each other across the sheet conveyed. The control circuit changes a level of a transmission instruction signal to be sent to the drive circuit to a level instructing to start feeding of the drive signal to the transmitter circuit. At a lapse of a wait time after the level of the transmission instruction signal is changed to the level instructing to start feeding of the drive signal to the transmitter circuit, the control circuit changes a level of a charging instruction signal to a level instructing to start execution of charging. In response to the level of the charging instruction signal changing to the level instructing to start execution of charging, the integrator circuit performs charging of an output of the receiver circuit during a charging time determined in advance. When adjusting the wait time, the control circuit executes processing for adjustment a plurality of times. The control circuit, in each execution of the processing for adjustment, changes the level of the transmission instruction signal, changes the level of the charging instruction signal, and recognizes the magnitude of the judgment voltage. The control circuit makes the wait time different in each execution of the processing for adjustment. The control circuit determines a new wait time as the wait time based on the magnitude of the judgment voltage recognized in the processing for adjustment.

According to another aspect of the present disclosure, a method for controlling a sheet conveyance device includes transmitting ultrasonic waves from a transmitter circuit provided on a conveyance path for sheets fed out by a sheet feed rotary body, making a receiver circuit provided on the conveyance path for sheets output an electric charge in accordance with intensity of the ultrasonic waves received, using an integrator circuit to perform charging of electric charge outputted from the receiver circuit and to output a judgment voltage having a magnitude in accordance with an amount of electric charge charged, using a drive circuit to feed the transmitter circuit with a drive signal for having the ultrasonic waves transmitted, judging, based on the magnitude of the judgment voltage, whether or not multiple feeding has occurred, arranging the transmitter circuit and the receiver circuit opposite each other across the sheet conveyed, changing a level of a transmission instruction signal to a level instructing to start feeding of the drive signal to the transmitter circuit, at a lapse of a wait time after the level of the transmission instruction signal is changed to the level instructing to start feeding of the drive signal to the transmitter circuit, changing a level of a charging instruction signal to a level instructing to start execution of charging, in response to the level of the charging instruction signal changing to the level instructing to start execution of charging, making the integrator circuit perform charging of an output of the receiver circuit during a charging time determined in advance, and when adjusting the wait time, executing processing for adjustment a plurality of times, recognizing the magnitude of the judgment voltage in each execution of the processing for adjustment, making the wait time different in each execution of the processing for adjustment, and determining a new wait time as the wait time based on the magnitude of the judgment voltage recognized in the processing for adjustment.

Further features and advantages of the present disclosure will become apparent from the description of embodiments given below.

DETAILED DESCRIPTION

In the present disclosure, for an appropriate timing to start charging, a wait time, which is a period from when ultrasonic waves are transmitted until when charging is started, is adjusted. This adjustment executed in the present disclosure contributed to an accurate judgment on whether or not multiple feeding has occurred. Below, an embodiment of the present disclosure will be described with reference to FIG. 1 to FIG. 10. In the description, a multifunction peripheral 100 will be dealt with as an example of a sheet conveyance device. In the following description, a document sheet is dealt with as an example of a sheet. The multifunction peripheral 100 is also a type of an image forming apparatus. It should however be noted that the features specifically described below in terms of configuration, arrangement, etc. in connection with the embodiment are all merely illustrative and are not meant to limit the scope of the disclosure.

(Outline of Multifunction Peripheral 100)

Figure 1:
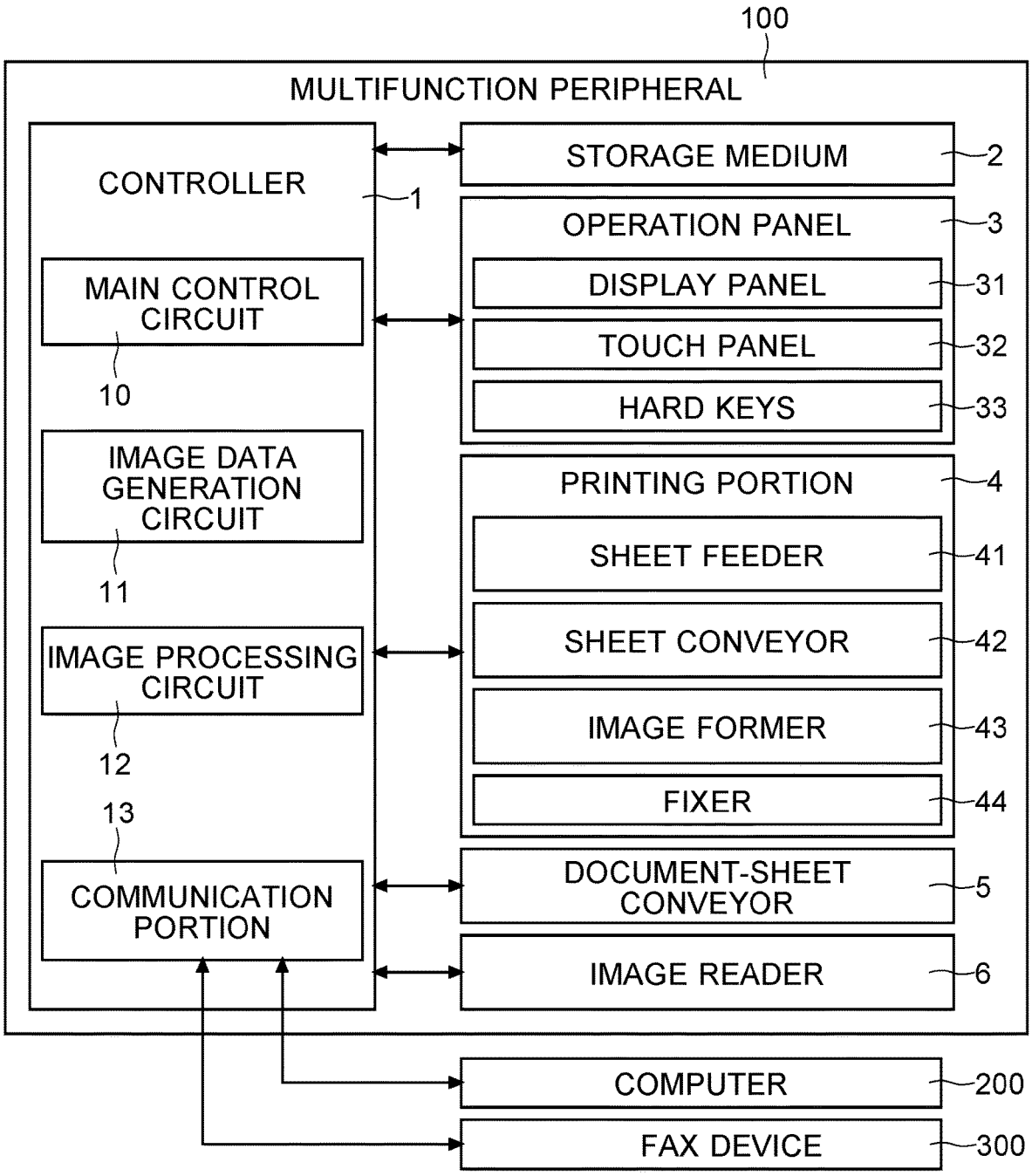
FIG. 1 is a diagram showing a multifunction peripheral according to an embodiment.

First, with reference to FIG. 1, a description will be given of the outline of the multifunction peripheral 100 according to the embodiment. As shown in FIG. 1, the multifunction peripheral 100 includes a controller 1, a storage medium 2, an operation panel 3, a printing portion 4, a document-sheet conveyor 5, and an image reader 6.

The controller 1 controls operations of the multifunction peripheral 100. The controller 1 controls operations in jobs such as copying, transmission, etc. The controller 1 is a circuit board (a main control circuit board) including a main control circuit 10, an image data generation circuit 11, an image processing circuit 12, and a communication portion 13. The main control circuit 10 is, for example, a CPU. The main control circuit 10 performs processing and calculation related to a job. For example, the image data generation circuit 11 includes a circuit that processes an analog image signal. For example, the image data generation circuit 11 includes an amplifier circuit, an offset circuit, and an A/D converter circuit. The A/D converter circuit converts an analog image signal adjusted by the amplifier circuit and the offset circuit into a digital data (image data). The image reader 6 reads a document sheet to output an analog image signal, based on which the image data generation circuit 11 generates read image data. For example, the image data generation circuit 11 generates monochrome, gray, or multicolor read image data.

The image processing circuit 12 performs image processing on the read image data. For example, the image processing circuit 12 is an ASIC (an integrated circuit designed and developed for image processing). The image processing circuit 12 generates output image data. The controller 1 makes the printing portion 4 perform printing based on the output image data. The communication portion 13 includes a communication control circuit and a communication memory. The communication memory stores therein software for communication. The communication portion 13 communicates with a computer 200, a FAX device 300, etc. The computer 200 is, for example, a personal computer or a server. For example, the communication portion 13 receives print data from the computer 200 or the FAX device 300. The controller 1 makes the printing portion perform printing (a print job, printing of received FAX data) based on the received print data.

The multifunction peripheral 100 includes a RAM, a ROM, a storage (an HDD or an SSD) as the storage medium 2. The controller 1 controls various portions based on a program and data stored in the storage medium 2.

The operation panel 3 accepts settings from a user. The operation panel 3 includes a display panel 31, a touch panel 32, and hard keys 33. The controller 1 makes the display panel 31 display a message, a setting screen, etc. The controller 1 makes the display panel 31 display operation images. The operation images include a button, a key, and a tab, for example. Based on the output of the touch panel 32, the controller 1 recognizes an operated one of the operation images. The hard keys 33 include a start key and a ten-key pad. The touch panel 32 and the hard keys 33 accept setting operations (operations related to a job) performed by the user.

The printing portion 4 includes a sheet feeder 41, a sheet conveyor 42, an image former 43, and a fixer 44. The sheet feeder 41 includes a sheet cassette and a sheet feed roller. The sheet cassette holds sheets. The sheet feed roller feeds out the sheets. In a print job, the controller 1 makes the sheet feeder 41 feed the sheets. The sheet conveyor 42 includes a conveyance roller pair and a conveyance motor for conveying the sheets. The conveyance roller pair conveys the sheets. The conveyance motor turns the conveyance roller pair. The controller 1 makes the sheet conveyor 42 convey the sheets along a conveyance path.

The image former 43 includes, for example, a photoconductive drum, a charging device, an exposure device, a developing device, and a transfer roller. Based on the output image data, the controller 1 makes the image former 43 form a toner image. The controller 1 makes the image former 43 transfer the toner image to a sheet conveyed to the image former 43. The fixer 44 includes a heater, a fixing rotary body, and a fixing motor. The heater heats the fixing rotary body. A sheet is conveyed while being in contact with the fixing rotary body. In this manner, the toner image is fixed on the sheet. The controller 1 makes the fixer 44 perform fixing of the transferred toner image on the sheet. The sheet conveyor 42 discharges the printed sheet to outside the device.

(Document-Sheet Conveyor 5 and Image Reader 6)

Next, with reference to FIG. 2, a description will be given of an example of the document-sheet conveyor 5 and the image reader 6 according to the embodiment. The multifunction peripheral 100 includes the document-sheet conveyor 5 and the image reader 6. The document-sheet conveyor 5 may be referred to as an automatic document-sheet feeder (ADF, a document-sheet conveyance device). Over the image reader 6, the document-sheet conveyor 5 is provided. The combination of the document-sheet conveyor 5 and the image reader 6 is disposed, for example, above the multifunction peripheral 100.

Figure 2:
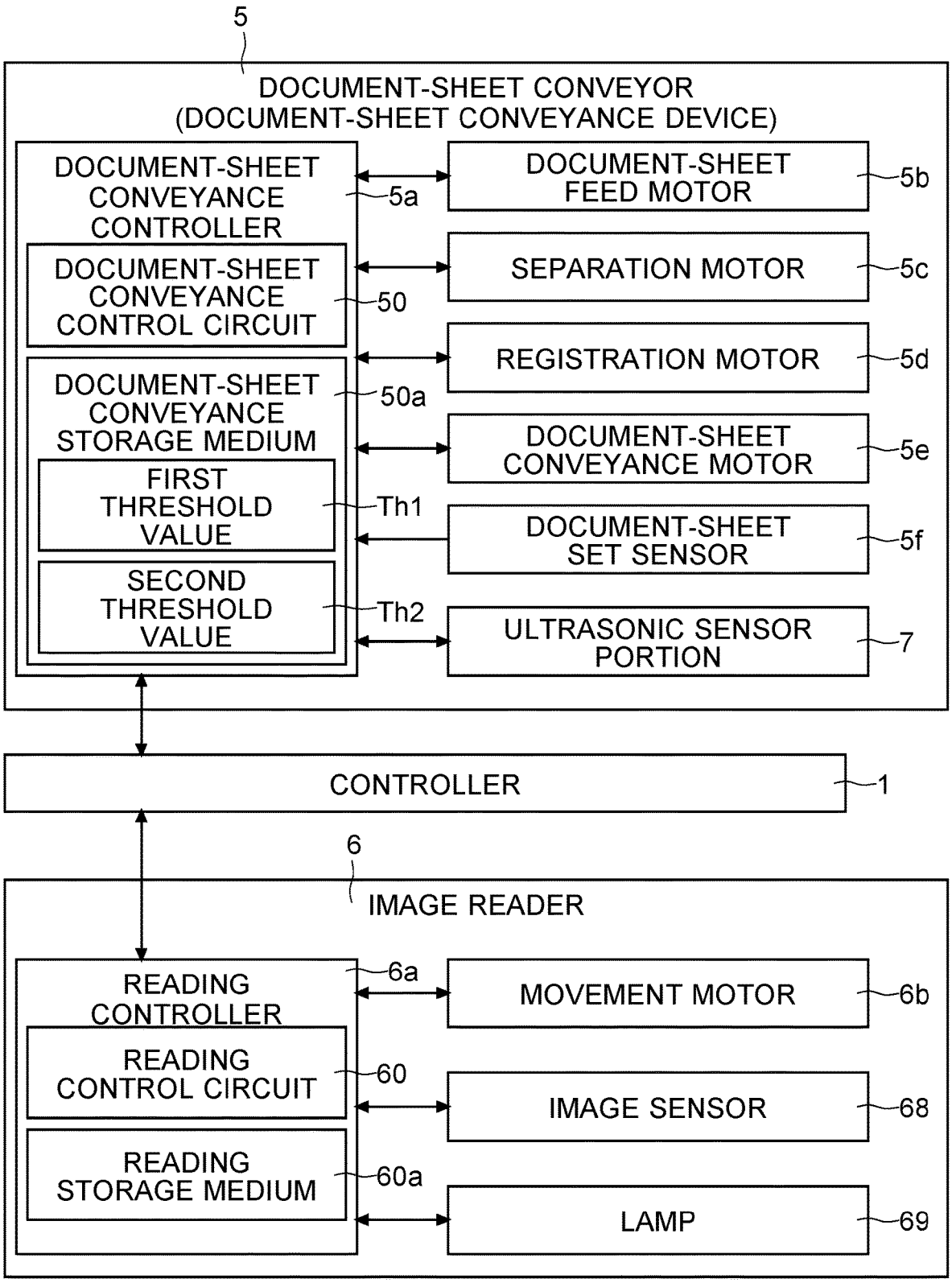
FIG. 2 is a diagram showing an example of a document-sheet conveyor and an image reader according to the embodiment.

As shown in FIG. 2, the document-sheet conveyor 5 includes a document-sheet conveyance controller 5*a*. The document-sheet conveyance controller 5*a* is connected to the controller 1. The document-sheet conveyance controller 5*a* includes a document-sheet conveyance control circuit 50 (corresponding to a control circuit) and a document-sheet conveyance storage medium 50*a*. The document-sheet conveyance controller 5*a* includes a ROM and a RAM as the document-sheet conveyance storage medium 50*a*. For example, the document-sheet conveyance controller 5*a* is a circuit board provided within the document-sheet conveyor 5.

In a job in which document reading is performed, the controller 1 gives the document-sheet conveyance controller 5*a* an instruction to convey a document-sheet (a sheet). The job in which document reading is performed is, for example, a copy job, a transmission job, or the like. Based on the instruction from the controller 1, the document-sheet conveyance controller 5*a* controls a document-sheet conveyance operation performed by the document-sheet conveyor 5. Specifically, the document-sheet conveyance controller 5*a* performs drive control on a document-sheet feed motor 5*b*, a separation motor 5*c*, a registration motor 5*d*, and a document-sheet conveyance motor 5*e*. The document-sheet conveyance controller 5*a* controls ON/OFF and rotational speeds of these motors.

The image reader 6 includes a reading controller 6*a*. The reading controller 6*a* is also connected to the controller 1. The reading controller 6*a* includes a reading control circuit 60 and a reading storage medium 60*a*. The reading controller 6*a* includes a ROM and a RAM as the reading storage medium 60*a*. For example, the reading controller 6*a* is a circuit board provided within the image reader 6.

In a job in which document reading is performed, the controller 1 gives the reading controller 6*a* an instruction to perform document reading. Based on the instruction from the controller 1, the reading controller 6*a* controls an operation of document-sheet reading. Specifically, the reading controller 6*a* performs drive control on a movement motor 6*b*, a lamp 69, and an image sensor 68 (a line sensor).

Figure 3:
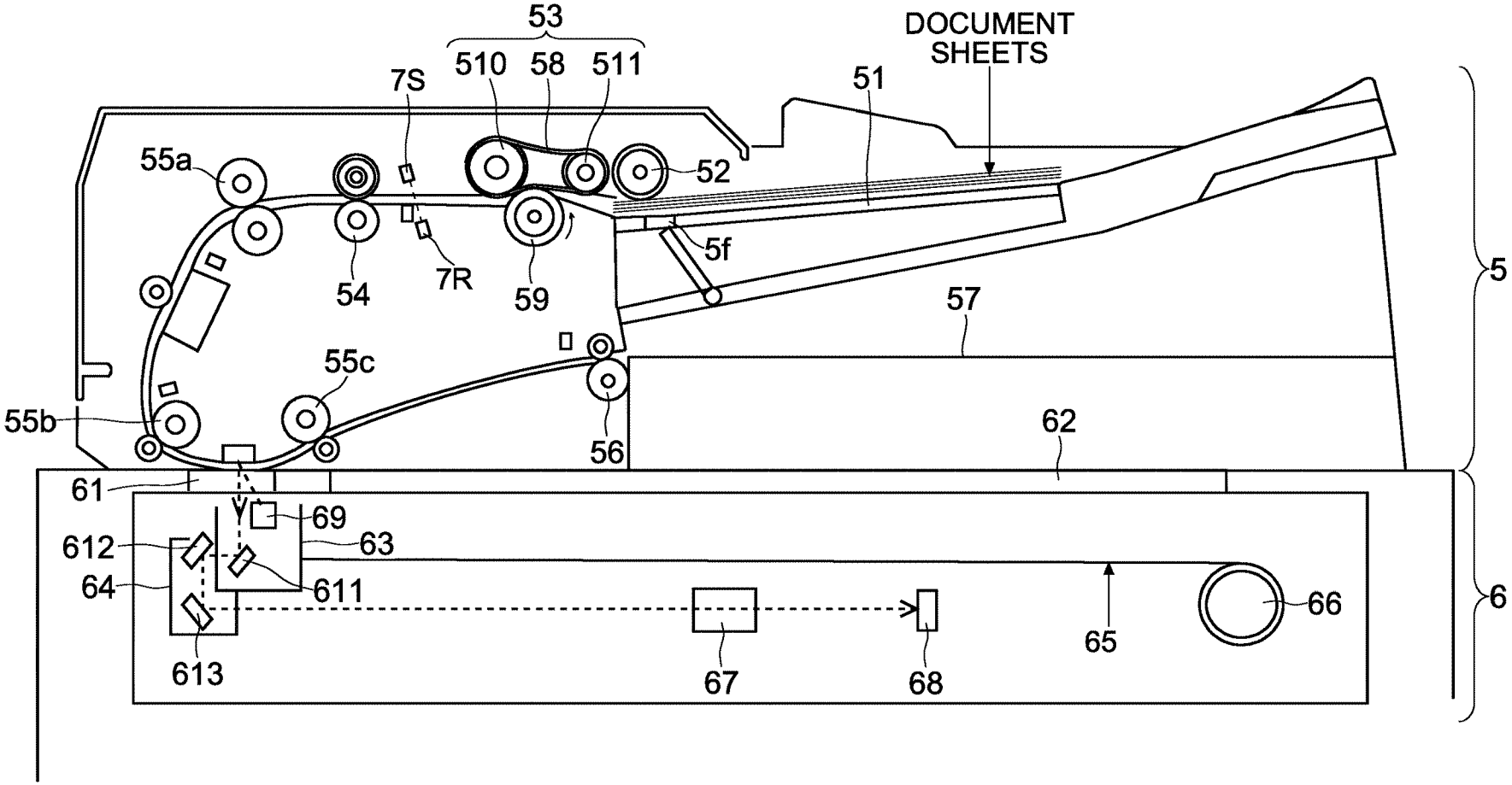
FIG. 3 is a diagram showing the example of the document-sheet conveyor and the image reader according to the embodiment.

As shown in FIG. 3, on an upper face of the image reader 6, a feed-reading contact glass 61 and a table-reading contact glass 62 are provided. The document-sheet conveyor 5 is openable and closable at a front side of the multifunction peripheral 100 in an up-down direction. To set a document sheet on the table-reading contact glass 62, the user lifts the document-sheet conveyor 5. The document-sheet conveyor 5 functions as a cover to press the contact glasses of the image reader 6 from above. On the other hand, when a document sheet is set on a document-sheet tray 51, the document-sheet conveyor 5 conveys the document sheet (corresponding to a sheet) toward the feed-reading contact glass 61 of the image reader 6.

As shown in FIG. 3, the document-sheet conveyor 5 includes, in order from an upstream side in a document-sheet conveyance direction, the document-sheet tray 51, a sheet feed roller 52, a separation conveyance portion 53, a registration roller pair 54, a plurality of document-sheet conveyance roller pairs 55*a*, 55*b*, and 55*c*, a document-sheet discharge roller pair 56, and a document-sheet discharge tray 57. The user sets on the document-sheet tray 51 a document sheet that the user wishes to have read.

The document-sheet conveyor 5 includes a document-sheet set sensor 5*f*. The output level of the document-sheet set sensor 5*f* differs depending on whether a document sheet has been set or not. The output of the document-sheet set sensor 5*f* is fed to the document-sheet conveyance controller 5*a*. Based on the output of the document-sheet set sensor 5*f*, the document-sheet conveyance controller 5*a* recognizes whether or not there is a document sheet on the document-sheet tray 51. The document-sheet conveyance controller 5*a* informs the controller 1 of the presence/absence of a document. The controller 1 recognizes whether or not a document sheet is set on the document-sheet tray 51.

The document-sheet conveyor 5 feeds and conveys document sheets on the document-sheet tray 51 one by one. The document-sheet conveyor 5 automatically and continuously feeds out the document sheets with sheet-to-sheet intervals between them. The document sheets are finally discharged into the document-sheet discharge tray 57. The feed-reading contact glass 61 is located on a conveyance path for document sheets. A reading position in feed reading is above the feed-reading contact glass 61. In the feed reading, the controller 1 makes the image reader 6 read a document sheet passing over the feed-reading contact glass 61.

The sheet feed roller 52 (corresponding to the sheet feed rotary body) is so positioned as to contact a downstream-side end part of a document sheet set on the document-sheet tray 51. The document sheet feed motor 5*b* turns the sheet feed roller 52. In the feed reading, the document-sheet conveyance controller 5*a* turns the document sheet feed motor 5*b*. The sheet feed roller 52 turns to feed a document sheet out of the document-sheet tray 51. In this manner, the document sheet is supplied. The separation conveyance portion 53 includes a sheet feed belt 58, a separation roller 59, a drive roller 510, and a driven roller 511. The sheet feed belt 58 is wound around the drive roller 510 and the driven roller 511. The sheet feed belt 58 turns in a direction of sending the document sheet toward the downstream side.

The document sheet feed motor 5*b* also turns the drive roller 510. Thereby, the sheet feed belt 58 is made to rotate in the direction of sending the document sheet toward the downstream side. The separation roller 59 is so positioned as to face the sheet feed belt 58. The separation motor 5*c* turns the separation roller 59. The document-sheet conveyance controller 5*a* also turns the separation motor 5*c* along with the document sheet feed motor 5*b*.

In multiple feeding, two or more document sheets (sheets) are conveyed in an overlapping state. The two or more document sheets may completely overlap each other or partially overlap each other. For example, two document sheets may be conveyed with a rear part of one document sheet overlapping a front part of the other document sheet. The separation roller 59 turns in a direction of conveying a document sheet back into the document-sheet tray 51. In a case of multiple feeding of sheets, the separation roller 59 separates the sheets from each other. A lower one of the document sheets is conveyed back toward the document-sheet tray 51. Here, a torque limiter is provided on a rotation shaft of the separation roller 59. When only one document sheet is conveyed, the separation roller 59 is made by the torque limiter to turn in a direction of conveying the document sheet toward the downstream side.

A tip end (a downstream-side end part) of a document sheet having passed through the separation conveyance portion 53 reaches the registration roller pair 54. The registration roller pair 54 is not made to start turning at the same time as the tip end of the document sheet reaches the registration roller pair 54. The tip end of the document sheet collides with a nip of the registration roller pair 54. As a result, the document sheet warps. Skewing of the document sheet is corrected. After the skewing is corrected, the document-sheet conveyance controller 5*a* makes the registration roller pair start turning. The registration motor 5*d* turns the registration roller pair 54. The document-sheet conveyance controller 5*a* turns the registration motor 5*d*.

The document-sheet conveyance roller pairs 55*a*, 55*b*, and 55*c* each convey the document sheet along the conveyance direction (from the upstream side toward the downstream side). The document-sheet discharge roller pair 56 discharges the document sheet into the document-sheet discharge tray 57 after the document sheet is being read. The document-sheet conveyance motor 5*e* turns each document-sheet conveyance roller pair and the document-sheet discharge roller pair 56. To convey a document sheet, the document-sheet conveyance controller 5*a* turns the document-sheet conveyance motor 5*e*.

Next, the image reader 6 will be described. As shown in FIG. 3, the image reader 6 includes, in its housing, a first movable frame 63, a second movable frame 64, a wire 65, a take-up drum 66, a lens 67, and an image sensor 68. The first movable frame 63 includes a lamp 69, which irradiates a document sheet (sheet) with light, and a first mirror 611. The second movable frame 64 includes a second mirror 612 and a third mirror 613. The lamp 69 is a linear light source that casts light in a line along a main scanning direction. The lamp 69 includes one LED or a plurality of LEDs, for example.

Two or more wires 65 are attached to the first movable frame 63 and the second movable frame 64. In FIG. 3, for convenience' sake, only one of the wires 65 is illustrated. The other end of the wire 65 is connected to the take-up drum 66. The movement motor 6*b* turns the take-up drum 66. The movement motor 6*b* is capable of turning in both forward and reverse directions. In a horizontal direction (a sub scanning direction, a left-right direction in FIG. 3), the first movable frame 63 and the second movable frame 64 are movable freely. A light-irradiation position (a position of a reading line) of lamp 69 can be moved.

The operation panel 3 accepts an instruction to start execution of a job. In response to the acceptance of the instruction to start execution of the job, the controller 1 checks whether or not a document sheet is set on the document-sheet tray 51. When there is a document sheet set, the controller 1 makes the document-sheet conveyor 5 and the image reader 6 perform feed reading. Specifically, the controller 1 makes the document-sheet conveyor 5 convey the document sheet. The controller 1 also makes the image reader 6 move the first movable frame 63 and the second movable frame 64 so that the position of the reading line will be within the range of the feed-reading contact glass 61. The controller 1 also makes the image reader 6 read the document sheet passing over the feed-reading contact glass 61.

When no document sheet is set on the document-sheet tray 51, the controller 1 makes the image reader 6 perform table reading. Specifically, the controller 1 makes the image reader 6 move the first movable frame 63 and the second movable frame 64 in the sub-scanning direction. As a result, the position of the reading line moves in the sub scanning direction. The controller 1 makes the image reader 6 read a document sheet set on the table-reading contact glass 62. Note that the controller 1 does not make the document-sheet conveyor 5 convey the document sheet.

When reading the document sheet, the reading controller 6*a* turns on the lamp 69. The lamp 69 irradiates the document sheet with light. The first mirror 611, the second mirror 612, and third mirror 613, via the lens 67, direct light reflected from the document sheet to be incident on the image sensor 68. The image sensor 68 includes a plurality of light receiving elements (photoelectric conversion elements). The light receiving elements are arranged in a line in the main scanning direction. The image sensor 68 is a line sensor. The image sensor 68 is capable of performing color reading. The image sensor 68 reads the document sheet line by line. The light receiving elements of the image sensor 68 each output an analog signal (an analog image signal) corresponding to an amount of light received. The analog image signal from each light receiving element is fed to the image data generation circuit 11. Based on the fed analog image signal, the image data generation circuit 11 generates read image data. The image reader 6 repeatedly performs line reading in the main scanning direction (a direction perpendicular to the conveyance direction). In this manner, reading of one document sheet is performed.

(Detection of Multiple Feeding)

Next, with reference to FIG. 3 to FIG. 5, a description will be given of an example of detection of multiple feeding in the sheet conveyance device according to the embodiment. To detect multiple feeding of document sheets, the multifunction peripheral 100 (the document-sheet conveyor 5) includes an ultrasonic sensor portion 7, a drive circuit 8, a delay circuit 9, and a selection circuit 90. The ultrasonic sensor portion 7 includes a transmitter circuit 7S, a receiver circuit 7R, and an integrator circuit 70. The integrator circuit 70 includes a charging circuit 71 and a discharging circuit 72. Here, presence and absence of a document sheet can be detected also by using the ultrasonic sensor portion 7, the drive circuit 8, the delay circuit 9, and the selection circuit 90.

The transmitter circuit 7S and the receiver circuit 7R are provided on the conveyance path for document sheets. For example, the transmitter circuit 7S and the receiver circuit 7R each include a piezoelectric element. As shown in FIG. 3, the transmitter circuit 7S and the receiver circuit 7R are arranged opposite each other across a sheet conveyed. The transmitter circuit 7S transmits ultrasonic waves. The receiver circuit 7R receives ultrasonic waves transmitted from the transmitter circuit 7S. An ultrasonic-wave transmitting face of the transmitter circuit 7S faces an ultrasonic-wave receiving face of the receiver circuit 7R. For example, the transmitter circuit 7S is arranged such that its ultrasonic-wave receiving face is inclined with respect to the document sheet. The receiver circuit 7R is also arranged to be inclined with respect to the document sheet.

The drive circuit 8 generates a drive signal S1 (a clock signal). The drive signal S1 includes a plurality of pulses (clocks). The drive signal S1 has a frequency determined in advance. The drive circuit 8 feeds the drive signal S1 to the transmitter circuit 7S (the piezoelectric element). The drive signal S1 vibrates the piezoelectric element of the transmitter circuit 7S. The vibration is transmitted through the air, and in this manner, ultrasonic waves are transmitted.

The receiver circuit 7R (the piezoelectric element) receives ultrasonic waves. On receiving the vibration of ultrasonic waves, the piezoelectric element outputs an electric charge (voltage). The integrator circuit 70 includes the charging circuit 71. The charging circuit 71 performs charging of the electric charge outputted from the receiver circuit 7R (the piezoelectric element). Here, an amplifier circuit may be provided between the piezoelectric element of the receiver circuit 7R and the charging circuit 71. In this case, the charging circuit 71 performs charging of an amplified output of the receiver circuit 7R. For the charging, the integrator circuit 70 (the charging circuit 71) includes, for example, a capacitor 73. And, the integrator circuit 70 outputs a judgment voltage V1 for judgment. For example, a voltage across the capacitor 73 is used as the judgment voltage V1. The judgment voltage V1 has a magnitude in accordance with the amount of electric charge charged through the charging performed by the charging circuit 71.

The judgment voltage V1 (voltage outputted from the integrator circuit 70) is fed to the document-sheet conveyance control circuit 50. Based on the magnitude of the judgment voltage V1, the document-sheet conveyance control circuit 50 (the controller 1) judges whether or not multiple feeding has occurred. The judgment voltage V1 changes stepwise depending on the number of document sheets present between the transmitter circuit 7S and the receiver circuit 7R. The judgment voltage V1 has a larger magnitude when there is no document sheet between the transmitter circuit 7S and the receiver circuit 7R than when there is one document sheet between the transmitter circuit 7S and the receiver circuit 7R. The judgment voltage V1 has a larger magnitude when there is only one document sheet between the transmitter circuit 7S and the receiver circuit 7R than when there are two or more document sheets between the transmitter circuit 7S and the receiver circuit 7R (multiple feeding).

The document-sheet conveyance storage medium 50*a* stores a first threshold value Th1 and a second threshold value Th2 therein in a non-volatile manner (see FIG. 2). The first threshold value Th1 is a value based on which to judge whether a document sheet is present or not (whether or not a sheet is passing). The second threshold value Th2 is a value based on which to judge whether or not multiple feeding has occurred. The first threshold value Th1 is larger than the second threshold value Th2.

Figure 5:
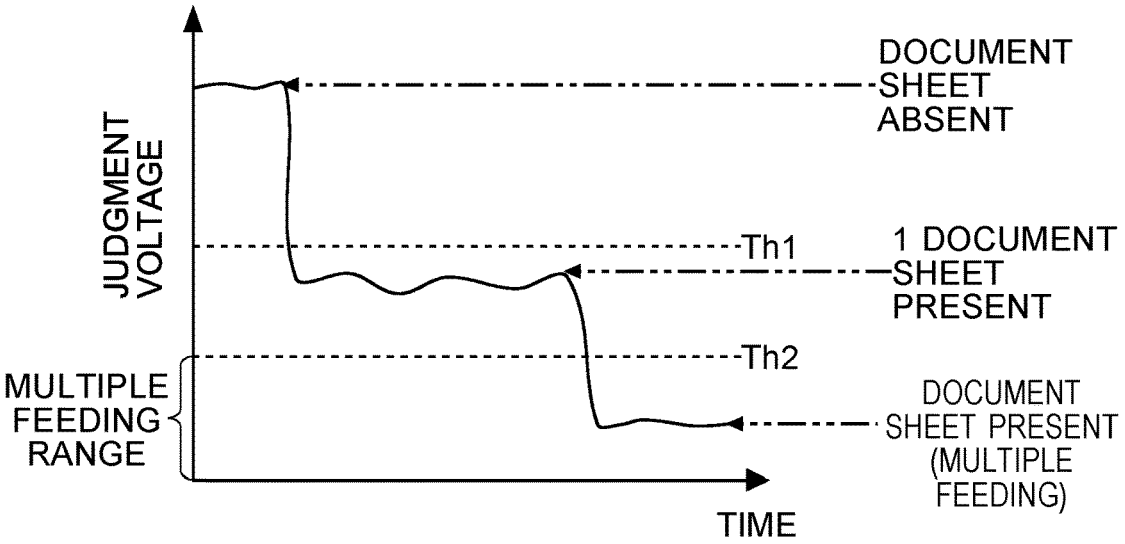
FIG. 5 is a diagram showing an example of a threshold value for judgment on multiple feeding according to the embodiment.

As shown in the graph of FIG. 5, when there is no document sheet between the transmitter circuit 7S and the receiver circuit 7R, ultrasonic waves are least attenuated. When there is one document sheet between the transmitter circuit 7S and the receiver circuit 7R, a value of the judgment voltage V1 based on the received ultrasonic waves is smaller than when there is no document sheet. The value of the judgment voltage V1 is even smaller in a case where multiple feeding has occurred (in a state where there are two or more document sheets between the transmitter circuit 7S and the receiver circuit 7R). This is partly because the ultrasonic waves are reflected between the document sheets.

The first threshold value Th1 is set to a value that is smaller than the judgment voltage V1 obtained when there is no document sheet but is larger than the judgment voltage V1 obtained when there is one document sheet. The second threshold value Th2 is set to a value that is smaller than the judgment voltage V1 obtained when there is one document sheet but is larger than the judgment voltage V1 obtained when multiple feeding has occurred. The document-sheet conveyance control circuit 50 recognizes the magnitude of the judgment voltage V1 (performs A/D conversion). The document-sheet conveyance control circuit 50 compares the judgment voltage V1 with the threshold values. When the judgment voltage V1 is equal to or smaller than the second threshold value Th2, the document-sheet conveyance control circuit 50 judges that multiple feeding has occurred. When the judgment voltage V1 is larger than the second threshold value Th2 but is equal to or smaller than the first threshold value Th1, the document-sheet conveyance control circuit 50 judges that one sheet is passing between the transmitter circuit 7S and the receiver circuit 7R. When the judgment voltage V1 is larger than the first threshold value Th1, the document-sheet conveyance control circuit 50 judges that no sheet is passing between the transmitter circuit 7S and the receiver circuit 7R.

(Multiple Feeding Detection Control in Sheet Conveyance)

Figure 6:
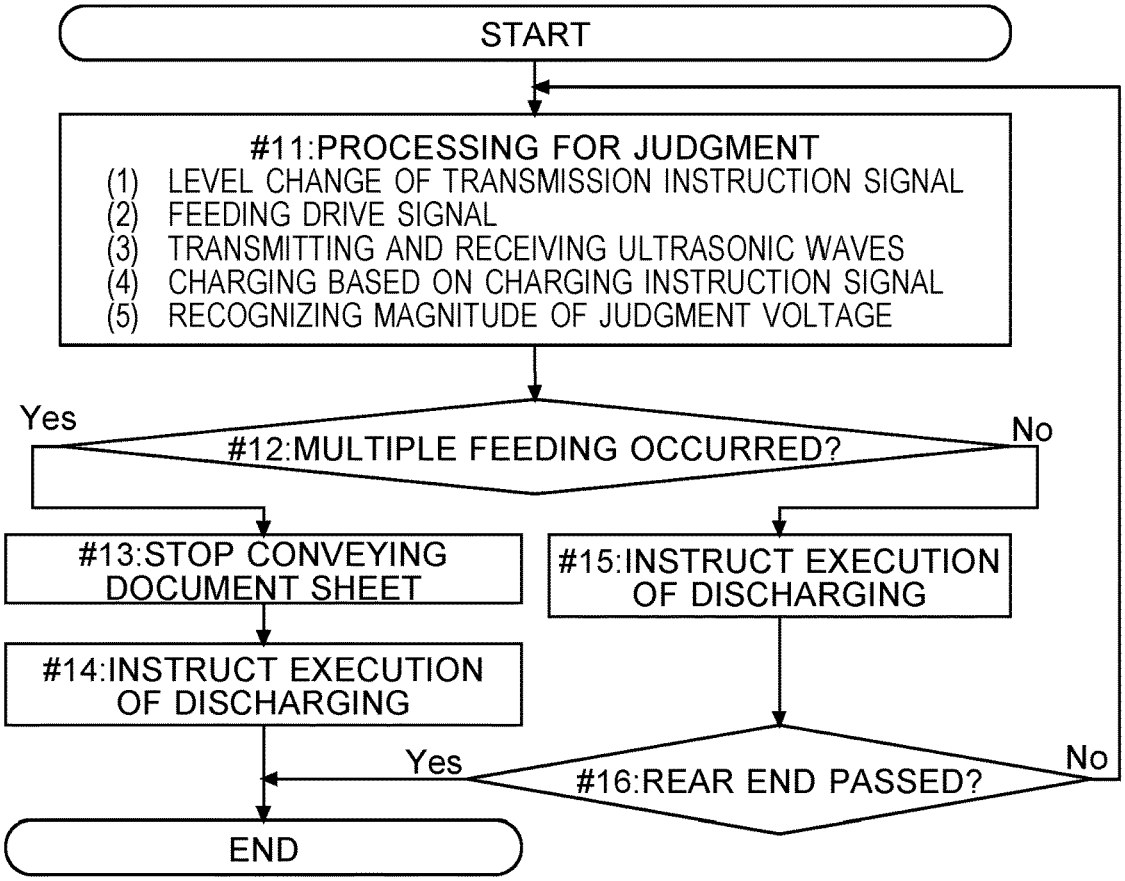
FIG. 6 is a diagram showing an example of a flow of controlling multiple feeding detection according to the embodiment.

Next, with reference to FIG. 6 to FIG. 8, a description will be given of an example of a flow of multiple feeding detection control performed in the multifunction peripheral 100 according to the embodiment. When a document sheet is conveyed, the document-sheet conveyance control circuit 50 performs detection of multiple feeding. "START" in FIG. 6 is a time point at which the document-sheet conveyance control circuit 50 starts turning the document sheet feed motor 5*b* to start feeding of document sheets. In a case where a plurality of document sheets are set on the document-sheet tray 51, the process shown in FIG. 6 is repeatedly performed with respect to each document sheet. First, the document-sheet conveyance control circuit 50 performs processing for judgment (step #11). The processing for judgment is a series of processing performed to have ultrasonic waves transmitted and received and to obtain the judgment voltage V1.

An example of the processing for judgment will be described with reference to FIG. 7. The document-sheet conveyance control circuit 50 and the drive circuit 8 are connected to each other by a first signal line L1 (see FIG. 4). The document-sheet conveyance control circuit 50 feeds a transmission instruction signal S0 to the drive circuit 8 via the first signal line L1. The transmission instruction signal S0 is a signal instructing to feed the transmitter circuit 7S with the drive signal S1. In FIG. 7, an uppermost chart shows an example of a waveform of the transmission instruction signal S0. In the example shown in FIG. 7, the document-sheet conveyance control circuit 50 lowers the transmission instruction signal S0 to Low level and thereby gives an instruction to feed the drive signal S1 to the transmitter circuit 7S.

Figure 4:
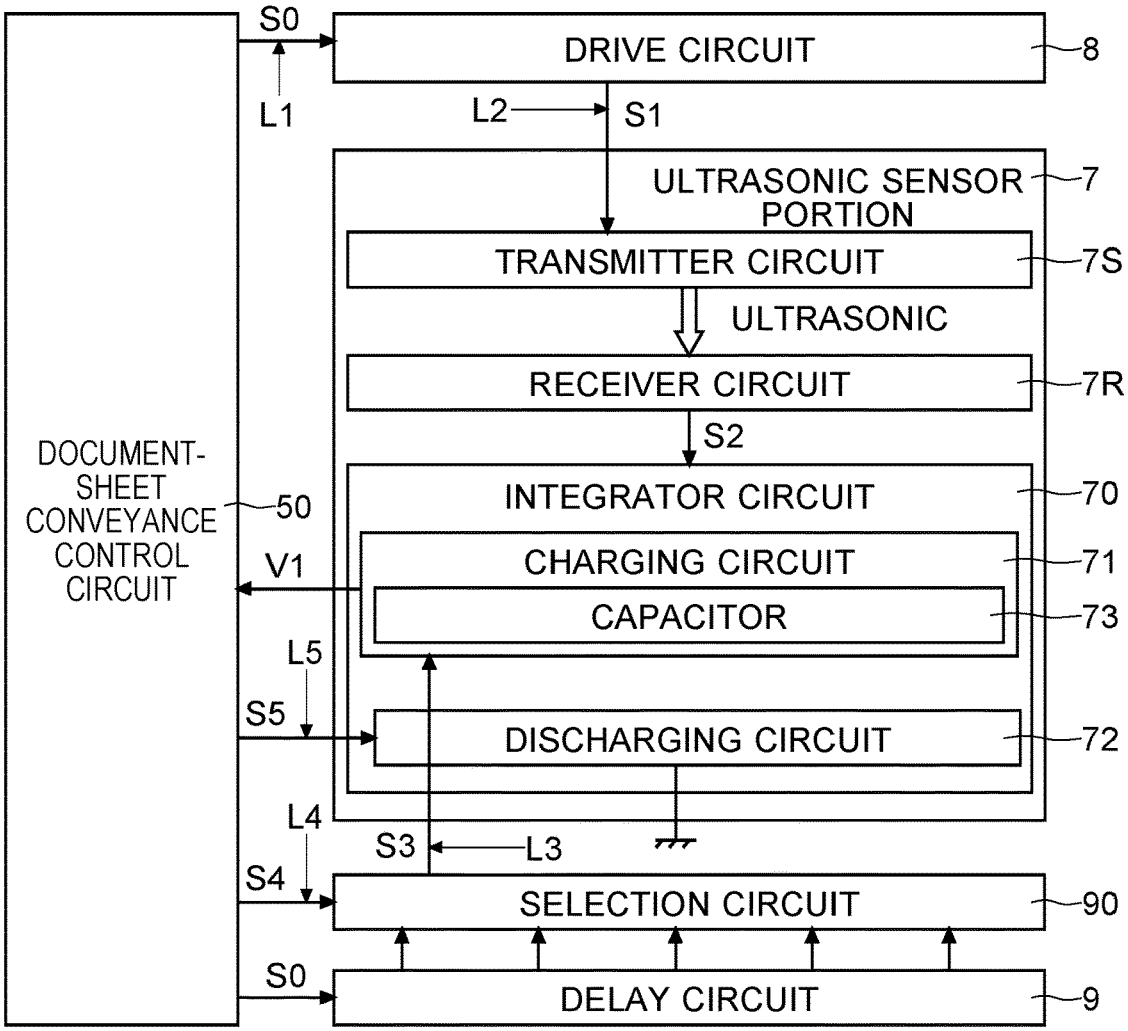
FIG. 4 is a diagram showing an example of an ultrasonic sensor portion according to the embodiment.

The drive circuit 8 and the transmitter circuit 7S are connected to each other by a second signal line L2 (see FIG. 4). The drive circuit 8 feeds the drive signal S1 to the transmitter circuit 7S via the second signal line L2. In FIG. 7, a second uppermost chart shows an example of a waveform of the drive signal S1. FIG. 7 shows an example where four pulses (clocks) are fed to the transmitter circuit 7S. While the transmission instruction signal S0 is at the level instructing to feed the transmitter circuit 7S with the drive signal S1 (that is, while the transmission instruction signal S0 is at Low level), the drive circuit 8 outputs clocks of a predetermined cycle as the drive signal S1.

A time during which the transmission instruction signal S0 remains at Low level (a time during which the transmission instruction signal S0 is maintained at the level instructing to feed the drive signal S1) is determined in advance. A time obtained by multiplying the number of clocks fed to the transmitter circuit 7S by one clock cycle is the time during which the transmission instruction signal S0 should be maintained at the level instructing to feed the drive signal S1 (the time during which the transmission instruction signal S0 should be maintained at Low level). The number of clocks to be fed to the transmitter circuit 7S may be, for example, any number of 4 to 11. For example, in a case where 11 clocks are fed, 11 times of one clock cycle is the length of time during which the transmission instruction signal S0 is maintained at the level instructing to feed the drive signal S1. At a lapse of this time, the document-sheet conveyance control circuit 50 changes the level of the transmission instruction signal S0. In the example shown in FIG. 7, the document-sheet conveyance control circuit 50 raises the transmission instruction signal S0 to High level.

Figure 7:
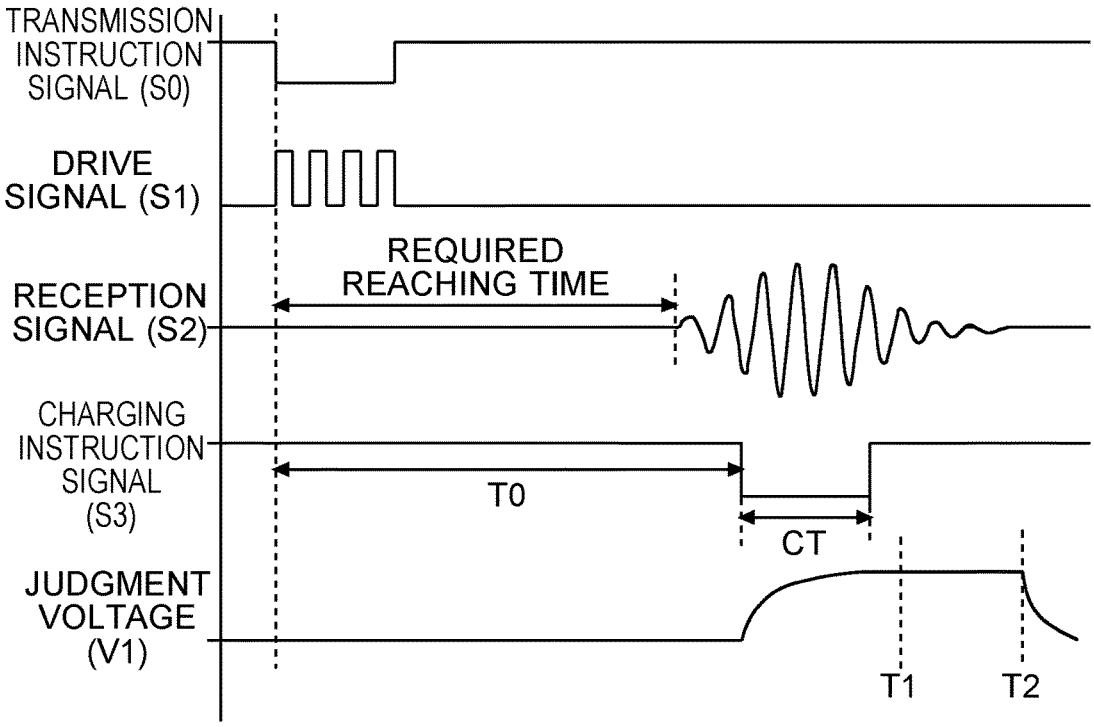
FIG. 7 is a diagram showing an example of processing for judgment performed in the multifunction peripheral according to the embodiment.

In FIG. 7, a third uppermost chart shows an example of a waveform of a reception signal S2 which the receiver circuit 7R outputs. In other words, what is shown is an example of a waveform of a voltage outputted from the piezoelectric element of the receiver circuit 7R. In accordance with vibration received, the voltage outputted from the receiver circuit 7R also vibrates. It is some time before the receiver circuit 7R receives ultrasonic waves after the start of the transmission of the ultrasonic waves from the transmitter circuit 7S based on the drive signal S1. In FIG. 7, the time from when the ultrasonic waves start to be transmitted until when the ultrasonic waves start to be received is illustrated as required reaching time.

The selection circuit 90 and the integrator circuit 70 are connected to each other by a third signal line L3 (see FIG. 4). The document-sheet conveyance control circuit 50 feeds a charging instruction signal S3 to the integrator circuit 70 via the delay circuit 9, the selection circuit 90, and the third signal line L3. In FIG. 7, a fourth uppermost chart shows an example of a waveform of the charging instruction signal S3 fed to the integrator circuit 70. In the example shown in FIG. 7, Low level means execution of charging. While the charging instruction signal S3 is at a level instructing to execute charging (while the charging instruction signal S3 is at Low level), the integrator circuit 70 performs charging of the electric charge outputted from the receiver circuit 7R. For example, when the charging instruction signal S3 falls to Low level, the integrator circuit 70 connects the receiver circuit 7R to the capacitor 73. Via this connection, the electric charge outputted from the receiver circuit 7R is charged to the capacitor 73. Then, as shown in FIG. 7 by the fourth uppermost chart, the time from when the document-sheet conveyance control circuit 50 changes the level of the transmission instruction signal S0 to the level instructing to feed the transmitter circuit 7S with the drive signal S1 (from the start of the transmission of ultrasonic waves) until when charging is started is a wait time T0. In the example shown in FIG. 7, the wait time T0 is a time from when the transmission instruction signal S0 falls to Low level until when the charging instruction signal S3 falls to Low level.

A period (charging time CT) during which the integrator circuit 70 continues to be charged is determined in advance. At a lapse of the charging time CT after the start of charging, the integrator circuit 70 finishes the charging. For example, the integrator circuit 70 disconnects the receiver circuit 7R and the capacitor 73 from each other.

Here, the document-sheet conveyor 5 includes the delay circuit 9. FIG. 8 shows an example of the delay circuit 9. The delay circuit 9 includes an input terminal 9*i*. The input terminal 9*i* is connected to a first buffer 91. The first buffer 91 delays a signal (level change of the signal) fed to the input terminal 9*i* by a first delay time A determined in advance. The document-sheet conveyance control circuit 50 feeds the transmission instruction signal S0 to the input terminal 9*i*. Then, an output from the first buffer 91 is fed to the selection circuit 90.

The delay circuit 9 includes a plurality of branch circuits 93 (branch portions). The plurality of branch circuits 93 are connected in parallel to the output of the first buffer 91. FIG. 8 shows an example in which the delay circuit 9 includes four branch circuits 93. The branch circuits 93 each include one or a plurality of second buffers 92. In a branch circuit 93 that includes a plurality of second buffers 92, the second buffers 92 are connected in series. Each second buffer 92 delays the signal (level change of the signal) fed to the input terminal 9*i* by a second delay time t determined in advance. Then, an output from a final-stage second buffer 92 of each branch circuit 93 is fed to the selection circuit 90. For example, the second delay time t is any time between 1 to 5 μs.

Figure 8:
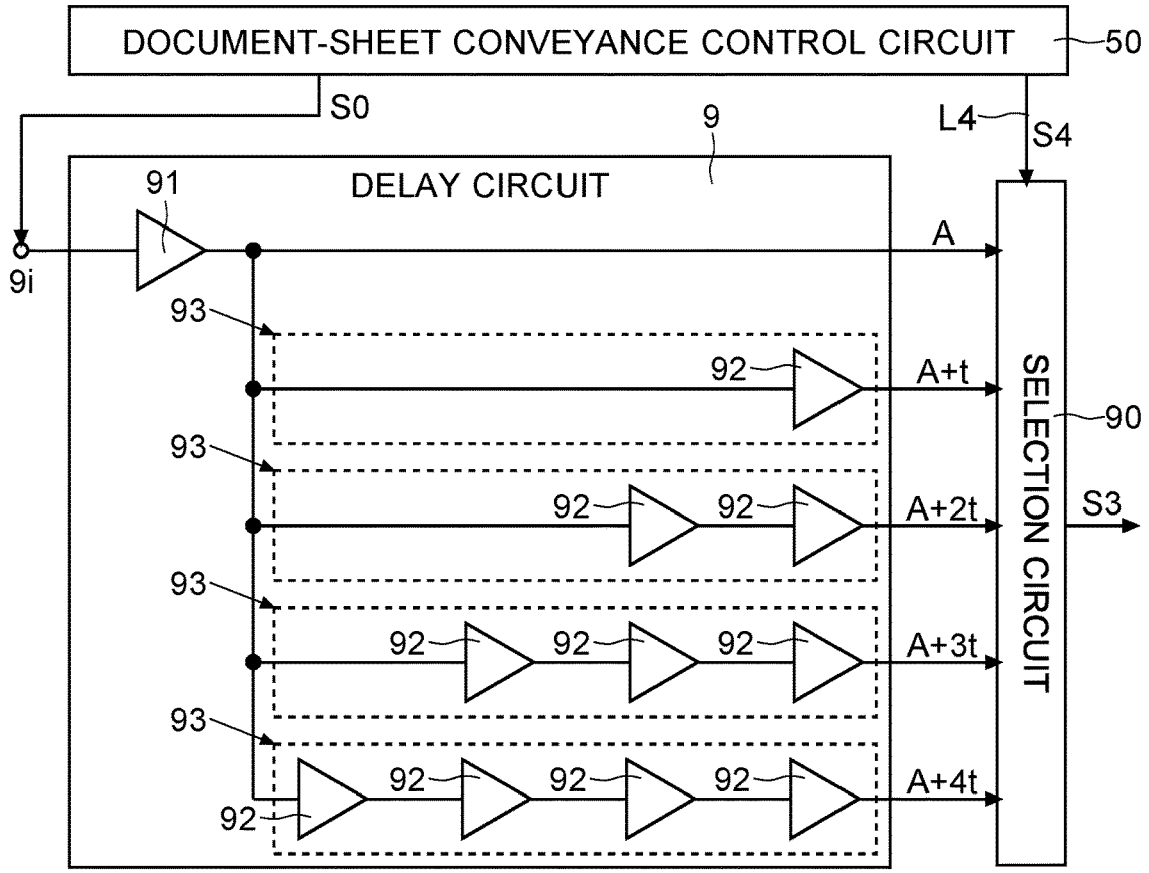
FIG. 8 is a diagram showing an example of a delay circuit according to the embodiment.

In the case shown in FIG. 8, the first delay time A of the first buffer 91 is A seconds. The second delay time t of each second buffers 92 is t seconds. The delay time of an uppermost signal line (output of the first buffer 91) of the delay circuit 9 is A seconds. The delay time of a second uppermost signal line (output of an uppermost branch circuit 93 in FIG. 8) of the delay circuit 9 is A+t seconds. The delay time of a third uppermost signal line (output of a second uppermost branch circuit 93 in FIG. 8) of the delay circuit 9 is A+2t seconds. The delay time of a fourth uppermost signal line (output of a third uppermost branch circuit 93 in FIG. 8) of the delay circuit 9 is A+3t seconds. The delay time of a fifth uppermost signal line (output of a fourth uppermost branch circuit 93 in FIG. 8) of the delay circuit 9 is A+4t seconds.

The selection circuit 90 is a circuit having a plurality of inputs and one output. The selection circuit 90 is a multiplexer, for example. The selection circuit 90 is a circuit that outputs, as the charging instruction signal S3, one of signals fed from the delay circuit 9. The document-sheet conveyance control circuit 50 and the selection circuit 90 are connected to each other by a fourth signal line L4 (see FIG. 4). The document-sheet conveyance control circuit 50 feeds a selection control signal S4 to the selection circuit 90 via the fourth signal line L4. The selection control signal S4 is a signal selecting which signal, from among the signals fed from the delay circuit 9, to be outputted to the selection circuit 90. The selection circuit 90 outputs, from among the signals fed from the delay circuit 9, a signal of a signal line specified by the selection control signal S4, as the charging instruction signal S3. The wait time T0 (the time from the start of the transmission of ultrasonic waves until the start of charging) can be different depending on which signal the selection circuit 90 selects.

In FIG. 7, a lowermost chart (a fifth uppermost chart) shows an example of the judgment voltage V1 (output voltage of the integrator circuit 70). The judgment voltage V1 increases as the charging proceeds. As the receiver circuit 7R outputs a larger amount of electric charge per unit time, the judgment voltage V1 rises more sharply. When the charging time CT ends, the document-sheet conveyance control circuit 50 recognizes the magnitude of the judgment voltage V1. In FIG. 7, for example, the document-sheet conveyance control circuit 50 recognizes the magnitude of the judgment voltage V1 at time point T1. After the transmission instruction signal S0 is fed, by the recognizing of the judgment voltage V1, one execution of the processing for judgment is completed.

On obtaining the judgment voltage V1, the document-sheet conveyance control circuit 50 judges whether or not multiple feeding has occurred (step #12). When judging that multiple feeding has occurred (Yes in step #12), the document-sheet conveyance control circuit 50 stops the conveyance of the document sheets (step #13). At this time, the document-sheet conveyance control circuit 50 may make the display panel 31 display a notification notifying the occurrence of a multiple feeding error. Further, the document-sheet conveyance control circuit 50 may inform the controller 1 of the occurrence of the multiple feeding error.

The document-sheet conveyance control circuit 50 and the discharging circuit 72 (the integrator circuit 70) are connected to each other by a fifth signal line L5 (see FIG. 4). The document-sheet conveyance control circuit 50 feeds a discharging instruction signal S5 to the discharging circuit 72 via the fifth signal line L5. Then, the document-sheet conveyance control circuit 50 changes the level of the discharging instruction signal S5 to a level instructing to execute discharging (step #14). Based on this instruction, the integrator circuit 70 (the discharging circuit 72) discharges the electric charge charged. On detecting multiple feeding, the document-sheet conveyance control circuit 50 lowers the judgment voltage V1 to zero in preparation for a next charge. Then, the document-sheet conveyance control circuit 50 finishes the processing of the present flowchart (END).

Also when judging that multiple feeding has not occurred, (No in step #12), the document-sheet conveyance control circuit 50 changes the level of the discharging instruction signal S5 to the level instructing to execute discharging (step #15). Based on this instruction, the integrator circuit 70 (the discharging circuit 72) discharges the electric charge charged. The document-sheet conveyance control circuit 50 lowers the judgment voltage V1 to zero before next charging starts. Time point T2 in FIG. 7 shows an example of a time point at which the level of the discharging instruction signal S5 is changed.

In the integrator circuit 70, the discharging circuit 72 performs the discharging of the electric charge (see FIG. 4). For example, the discharging circuit 72 is a switch circuit that switches between connection and disconnection between a terminal of the capacitor 73 and a ground. For example, when the discharging instruction signal S5 is at the level instructing to execute discharging (Low level), the discharging circuit 72 connects the terminal of the capacitor 73 to the ground. When the discharging instruction signal S5 is at a level not instructing to execute discharging (High level), the discharging circuit 72 does not connect the terminal of the capacitor 73 to the ground.

And, the document-sheet conveyance control circuit 50 checks whether or not a rear end of a document sheet has passed by (step #16). For example, after recognizing, based on the judgment voltage V1, that a leading end of a document sheet has arrived (that is, one document sheet is present), if the document-sheet conveyance control circuit 50 recognizes, based on the judgment voltage V1, that no document sheet is present, the document-sheet conveyance control circuit 50 judges that a rear end of the document sheet has passed by.

When the rear end of the document sheet has not passed by yet (No in step #16), the document-sheet conveyance control circuit 50 performs step #11 again (returns to step #11). The judgment on multiple feeding is repeatedly made until the document sheet completely passes by. The transmission and reception of ultrasonic waves are performed periodically. On judging that the rear end of the document sheet has passed by (Yes in step #16), the document-sheet conveyance control circuit 50 finishes the processing of the present flowchart (END).

(Adjustment of Wait Time T0)

Figure 9:
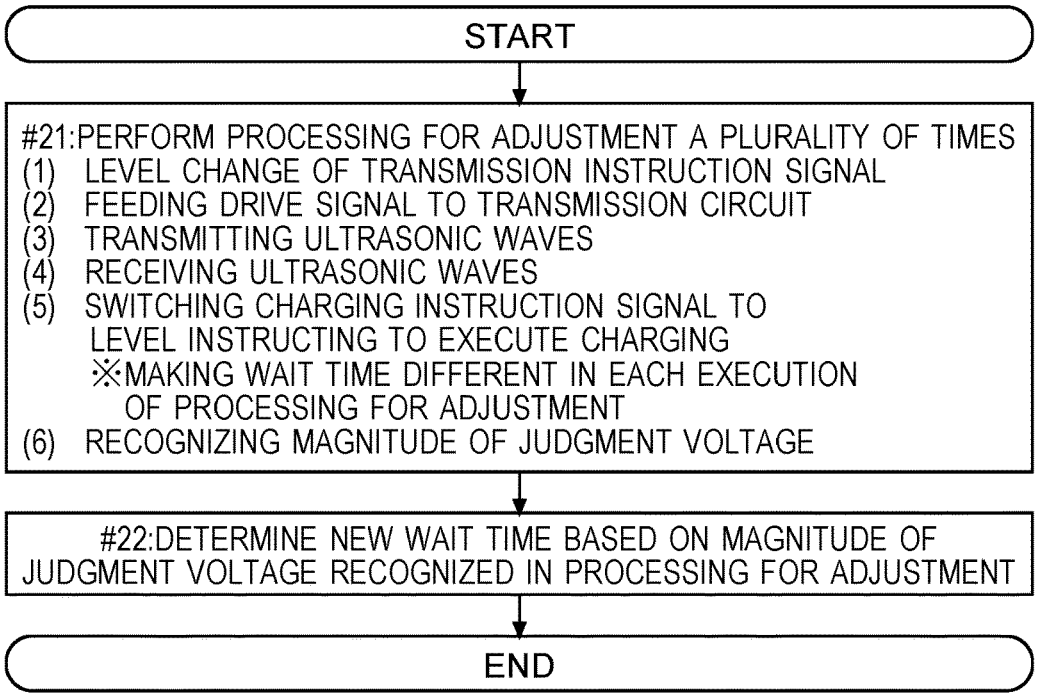
FIG. 9 is a diagram showing an example of how a wait time is adjusted in the multifunction peripheral according to the embodiment.

Next, with reference to FIG. 9 and FIG. 10, a description will be given of an example of adjustment of the wait time T0 in the multifunction peripheral 100 according to the embodiment.

The time (required reaching time) from when the level of the transmission instruction signal S0 is changed to the level instructing to feed the transmitter circuit 7S with the drive signal S1 (that is, from the transmission of ultrasonic waves) until when the ultrasonic waves are received by the receiver circuit 7R is affected by distance between the transmitter circuit 7S and the receiver circuit 7R. There is an error (a tolerance) in the installation positions of the transmitter circuit 7S and the receiver circuit 7R. There are cases where the distance between the transmitter circuit 7S and the receiver circuit 7R is not exactly equal to a specified (designed) distance. For example, the error can be by about one to several millimeters.

Conventionally, the wait time T0 is determined based on the specified (designed) distance between the transmitter circuit 7S and the receiver circuit 7R. For example, in a case where the distance between the transmitter circuit 7S and the receiver circuit 7R is equal to the specified (designed) distance, the wait time T0 is set such that a peak of the output of the receiver circuit 7R is included in the charging time CT. Conventionally, the wait time T0 is fixed. With the wait time T0 fixed, the error of the distance between the transmitter circuit 7S and the receiver circuit 7R may obstruct proper judgment on whether or not multiple feeding has occurred.

The required reaching time is affected by air temperature. Generally, ultrasonic waves travel faster (the sound speed is higher) under higher air temperature. It is also preferable to take the influence of temperature into consideration. If the wait time T0 is fixed, it cannot be adjusted according as the temperature changes and can invite erroneous detection of multiple feeding. To reduce or eliminate such erroneous detection, the multifunction peripheral 100 adjusts the wait time T0. With reference to FIG. 9 and FIG. 10, a description will be given of an example of the adjustment of the wait time T0. "START" in FIG. 9 is a time point at which the adjustment of the wait time T0 is started.

The document-sheet conveyance control circuit 50 may adjust the wait time T0 when no job is executed. Or, the document-sheet conveyance control circuit 50 may adjust the wait time T0 at a predetermined adjustment time point. For example, the document-sheet conveyance control circuit 50 may adjust the wait time T0 at a time point when it is found that temperature has changed by a value greater than a predetermined value within a predetermined period. The multifunction peripheral 100 includes a temperature sensor (not shown). Based on an output of the temperature sensor, the document-sheet conveyance control circuit 50 periodically recognizes the temperature.

When a main power supply of the multifunction peripheral 100 is turned on and thereby the document-sheet conveyance control circuit 50 is activated, the document-sheet conveyance control circuit 50 may adjust the wait time T0. When a power-saving mode is cancelled and thereby the document-sheet conveyance control circuit 50 is activated, the document-sheet conveyance control circuit 50 may adjust the wait time T0. The document-sheet conveyance control circuit 50 may adjust the wait time T0 at constant time intervals. The document-sheet conveyance control circuit 50 may adjust the wait time T0 at a time set on a timer. In this case, the operation panel 3 may accept the setting of the time at which to execute the adjustment of the wait time T0. The document-sheet conveyance control circuit 50 adjusts the wait time T0 at the set time. When an instruction is given via the operation panel 3 to adjust the wait time T0, the document-sheet conveyance control circuit 50 may start to execute the adjustment of the wait time T0.

First, the document-sheet conveyance control circuit 50 performs processing for adjustment a plurality of times (step #21). The number of times the processing for adjustment is executed is equal to the number of types of the charging instruction signal S3 that can be selected by the selection circuit 90. For example, if five types of inputs are fed to the selection circuit 90 (if the number of outputs from the delay circuit 9 is five), the document-sheet conveyance control circuit 50 performs the processing for adjustment five times.

The processing for adjustment is approximately the same as the processing for judgment. The description of the processing for judgment can be used to describe the processing for adjustment. Specifically, the processing for adjustment proceeds as follows: (1) The document-sheet conveyance control circuit 50 feeds the transmission instruction signal S0 to the drive circuit 8. The document-sheet conveyance control circuit 50 changes the level of the transmission instruction signal S0 to the level instructing to feed the drive signal S1 to the transmitter circuit 7S (that is, lowers the transmission instruction signal S0 to Low level). The instruction to feed the drive signal S1 to the transmitter circuit 7S is received by the drive circuit 8. (2) Based on the transmission instruction signal S0, the drive circuit 8 feeds the drive signal S1 (a predetermined number of clocks) to the transmitter circuit 7S. (3) Based on the drive signal S1, the transmitter circuit 7S continues to transmit ultrasonic waves during a certain period. (4) The receiver circuit 7R starts to receive the ultrasonic waves. (5) After the transmission instruction signal S0 is transmitted, the level of the charging instruction signal S3 changes to a level instructing to execute charging. Then, the charging circuit 71 starts to perform charging of the output from the receiver circuit 7R. (6) After a lapse of the charging time CT, before discharging, the document-sheet conveyance control circuit 50 recognizes the magnitude of the judgment voltage V1.

When adjusting the wait time T0, the document-sheet conveyance control circuit 50 makes the delay time (the wait time T0) different in each execution of the processing for adjustment. In this point, the processing for adjustment is different from the processing for judgment. Specifically, the document-sheet conveyance control circuit 50, in each execution of the processing for adjustment, makes the selection circuit 90 switch the output of the delay circuit 9 to be connected to the integrator circuit 70 (the charging circuit 71).

Figure 10:
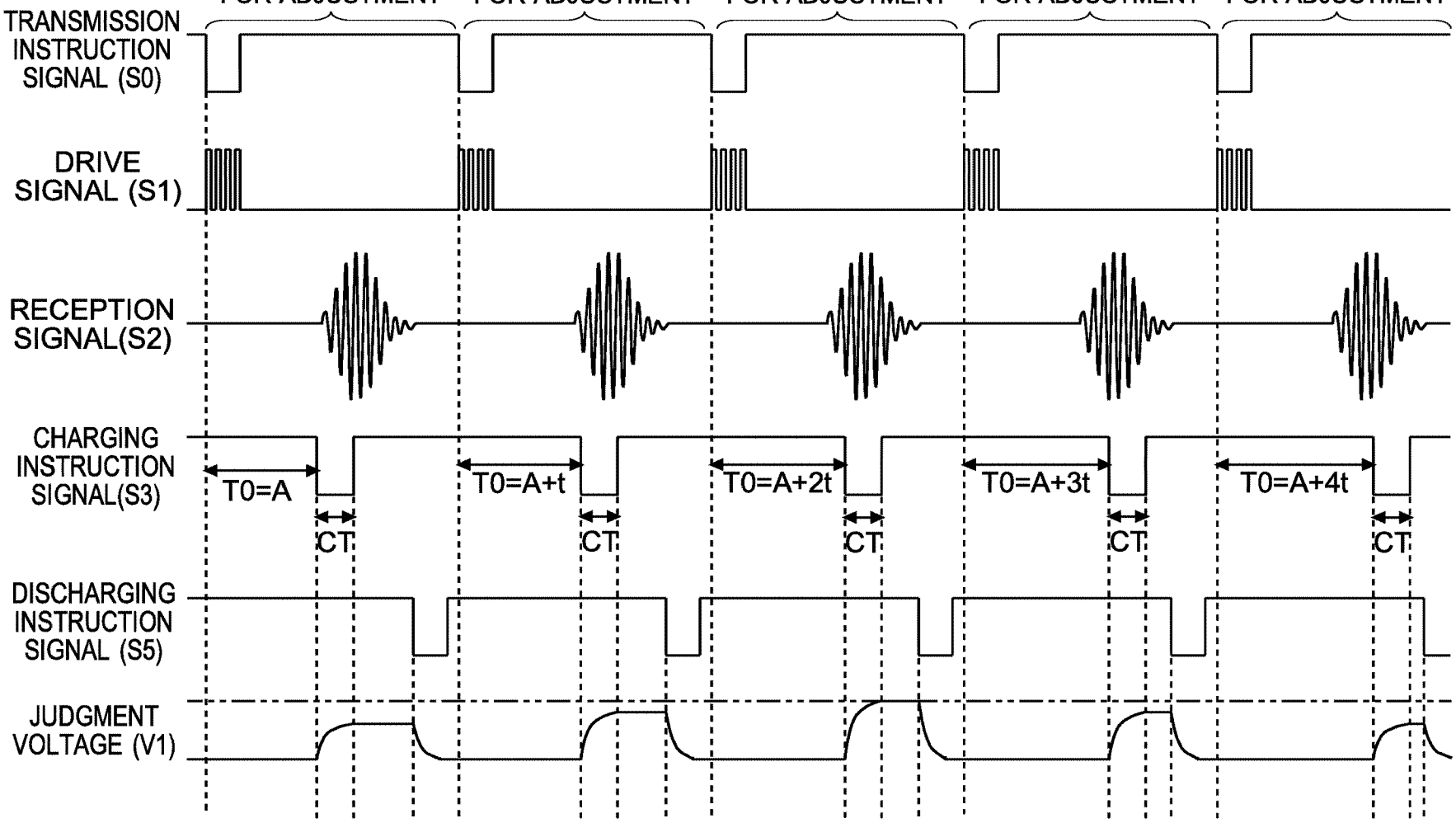
FIG. 10 is a diagram showing the example of the wait time in the multifunction peripheral according to the embodiment.

FIG. 10 shows an example of a waveform of each signal when the wait time T0 is adjusted. FIG. 10 also shows an example of switching of the delay time (the wait time T0) in each execution of the processing for adjustment. FIG. 10 shows an example where, each time the judgment voltage V1 is measured, the wait time T0 is switched to A, A+t, A+2t, A+3t, and A+4t in this order. The variation of the wait time T0 results in variation of the judgment voltage V1 in each execution of the processing for adjustment.

Here, as shown in FIG. 10, the document-sheet conveyance control circuit 50 feeds the discharging instruction signal S5 to the discharging circuit 72. In each execution of the processing for adjustment, before charging is started, the judgment voltage V1 is lowered to the zero level.

Based on the magnitude of the judgment voltage V1 recognized in the processing for adjustment, the document-sheet conveyance control circuit 50 determines a new wait time T0. Specifically, when adjusting the wait time T0, the document-sheet conveyance control circuit 50 determines, as a new wait time, the wait time T0 of the execution of the processing for adjustment in which the judgment voltage V1 is maximum. The judgment voltage V1 tends to be larger as time difference between a time point at which a peak-to-peak voltage of the judgment voltage V1 is the maximum and a middle point of the charging time CT is smaller. In the example shown in FIG. 10, the judgment voltage V1 is the maximum when the wait time T0 is equal to A+2t. In FIG. 10, the two-dot chain line indicates the maximum level of the judgment voltage V1. In this case, the document-sheet conveyance control circuit 50 determines A+2t as the new wait time T0 (step #22).

Here, in a case where, in determining the new wait time T0, there are a plurality of candidates for the wait time T0 with which the judgment voltage V1 is the maximum, the document-sheet conveyance control circuit 50 selects one of them or the median of them.

After the adjustment of the wait time T0 is completed, in the processing for judgment performed when a document sheet is conveyed, the document-sheet conveyance control circuit 50 changes the level of the transmission instruction signal S0 to the level instructing to feed the drive signal S1 to the transmitter circuit 7S, and, at a lapse of the new wait time T0 from the level change, the document-sheet conveyance control circuit 50 has the charging instruction signal S3 of the level instructing to execute charging fed to the integrator circuit 70. Specifically, the document-sheet conveyance control circuit 50 controls the selection circuit 90 such that the output of the delay circuit 9 in the execution of the processing for adjustment in which the judgment voltage V1 is the maximum is fed to the integrator circuit 70 (the charging circuit 71) as the charging instruction signal S3.

The sheet conveyance device (the multifunction peripheral 100) according to the present embodiment includes the sheet feed rotary body (the sheet feed roller 52), the transmitter circuit 7S, the receiver circuit 7R, the integrator circuit 70, the drive circuit 8, and the control circuit (the document-sheet conveyance control circuit 50). The sheet feed rotary body feeds out a sheet. The transmitter circuit 7S is provided on the conveyance path for sheets fed out from the sheet feed rotary body, and transmits ultrasonic waves. The receiver circuit 7R is provided on the conveyance path. The receiver circuit 7R outputs an electric charge in accordance with the intensity of the ultrasonic waves received. The integrator circuit 70 performs charging of the electric charge outputted from the receiver circuit 7R. The integrator circuit 70 outputs the judgment voltage V1 having a magnitude in accordance with the amount of electric charge charged. The drive circuit 8 feeds the transmitter circuit 7S with the drive signal S1 for having ultrasonic waves transmitted. The control circuit, based on the magnitude of the judgment voltage V1, judges whether or not multiple feeding has occurred. The transmitter circuit 7S and the receiver circuit 7R are arranged opposite each other across the sheet conveyed. The control circuit changes the level of the transmission instruction signal S0 to be transmitted to the drive circuit 8 to the level instructing to start feeding of the drive signal S1 to the transmitter circuit 7S. At a lapse of the wait time T0 after changing the level of the transmission instruction signal S0 to the level instructing to start feeding of the drive signal S1 to the transmitter circuit 7S, the control circuit changes the level of the charging instruction signal S3 to the level instructing to start execution of charging. When the level of the charging instruction signal S3 changes to the level instructing to start execution of charging, the integrator circuit 70 performs charging of the output of the receiver circuit 7R during the charging time CT determined in advance. When adjusting the wait time T0, the control circuit performs the processing for adjustment a plurality of times. In each execution of the processing for adjustment, the control circuit recognizes the change of the level of the transmission instruction signal S0, the change of the level of the charging instruction signal S3, and the magnitude of the judgment voltage V1. The control circuit makes the wait time T0 different in each execution of the processing for adjustment. Based on the magnitude of the judgment voltage V1 recognized in the processing for adjustment, the control circuit determines a new wait time T0 as the wait time T0.

Based on the judgment voltage V1 obtained in each execution of the processing for adjustment, the wait time T0 (the time from when the transmission of ultrasonic waves is started until when charging is started) can be adjusted. It is possible, based on the processing for adjustment performed a plurality of times, to obtain a wait time T0 appropriate to deal with distance variation between the transmitter circuit 7S and the receiver circuit 7R and temperature change. The wait time T0 can be adjusted such that charging can be started at an appropriate time point. In contrast to the conventional case where the wait time T0 is fixed, an accurate judgment can be made on whether or not multiple feeding has occurred.

When adjusting the wait time T0, the control circuit determines, as a new wait time T0, the wait time T0 in the execution of the processing for adjustment in which the judgment voltage V1 is the maximum. The wait time T0 can be set such that a period during which an amplitude of output voltage of the receiver circuit 7R is sufficiently large is included in the charging time CT. Difference between the judgment voltage V1 obtained when there is no sheet and the judgment voltage V1 obtained when multiple feeding has occurred can be made as large as possible.

The sheet conveyance device (the multifunction peripheral 100) includes the delay circuit 9 which has one-input and multiple-output and in which the delay times of the signal fed thereto is different for each outputs. The sheet conveyance device includes the selection circuit 90; the outputs of the delay circuit 9 are all fed to the selection circuit 90, and the selection circuit 90 outputs one of the outputs of the delay circuit 9 as the charging instruction signal S3. When adjusting the wait time T0, the control circuit feeds the transmission instruction signal S0 to the input terminal 9*i* of the delay circuit 9. The delay circuit 9 delays the transmission instruction signal S0 fed thereto and outputs a plurality of signals with different delay times. The control circuit makes the selection circuit 90 switch the output of the delay circuit 9 to be given to the integrator circuit 70 in each execution of the processing for adjustment. Based on the transmission instruction signal S0, the charging instruction signal S3 can be generated. The control circuit does not need to separately transmit the charging instruction signal S3 after the transmission instruction signal S0 is transmitted. The control circuit can change the wait time T0 merely by using the selection circuit 90 to switch the output of the delay circuit 9, which is connected to the integrator circuit 70.

The delay circuit 9 includes the plurality of branch circuits 93 and the first buffer 91 which delays a signal (the transmission instruction signal S0) fed to the input terminal of the delay circuit 9. The plurality of branch circuits 93 are connected in parallel to the output of the first buffer 91. The branch circuits 93 each include one or a plurality of second buffers 92. The branch circuits 93 each include a different number of second buffers 92. In such a branch circuit 93 of the branch circuits 93 as includes a plurality of second buffers 92, the plurality of second buffers 92 are connected in series. An output of a second buffer 92 on a final stage is fed to the selection circuit 90. A plurality of signals of which levels are changed at different timings can be generated with a simple configuration.

When adjusting the wait time T0, the control circuit recognizes such an output of the plurality of outputs of the delay circuit 9 as is obtained when the judgment voltage V1 is the maximum. The control circuit sets the recognized output of the delay circuit 9 obtained when the judgment voltage V1 is the maximum as the output to be given to the integrator circuit 70, and thereby determines a new wait time T0. A new wait time T0 can be set merely by selecting one output to be used from among the outputs of the delay circuit 9. The wait time T0 can be adjusted easily.

The control circuit adjusts the wait time T0 at an adjustment time point which is determined in advance. After adjusting the wait time T0, until a next adjustment time point comes, the control circuit judges, by using the new wait time T0, whether or not multiple feeding has occurred. Adjustment of the wait time T0 can be performed at regular intervals. By using the adjusted wait time T0, an accurate judgment can be made on whether or not multiple feeding has occurred.

When the level of the discharging instruction signal S5 form the control circuit changes to the level instructing to start execution of discharging, the integrator circuit 70 discharges the electric charge charged. Before starting charging, the control circuit changes the level of the discharging instruction signal S5 to the level instructing to start execution of discharging. The control circuit lowers the judgment voltage V1 to zero before the charging is started. The voltage (electric charge) of which charging the integrator circuit 70 is to perform can be reset. After the resetting, another charging can be started.

It should be understood that the embodiments disclosed herein are merely illustrative in all respects, and should not be interpreted restrictively. The range of the present disclosure is shown not by the above descriptions of embodiments but the scope of claims for patent, and it is intended that all modifications within the meaning and range equivalent to the scope of claims for patent are included.

For example, the above description has dealt with a document sheet as a sheet. Instead, the sheet may be a printing sheet fed from the sheet feeder 41 to be used for printing. In this case, the transmitter circuit 7S and the receiver circuit 7R are provided on a conveyance path for printing sheets between the sheet feeder 41 and the image former 43. With respect to the transmitter circuit 7S and the receiver circuit 7R provided on the conveyance path for printing sheets, the integrator circuit 70 and the delay circuit 9 are provided. For example, the main control circuit 10 may judge whether or not multiple feeding has occurred based on the judgment voltage V1. The main control circuit 10 may adjust the wait time T0.

What is claimed is:

1. A sheet conveyance device comprising:

a sheet feed rotary body which feeds out a sheet;

a transmitter circuit which is provided on a conveyance path for the sheet fed out by the sheet feed rotary body and transmits ultrasonic waves;

a receiver circuit which is provided on the conveyance path for the sheet and outputs electric charge in accordance with intensity of the ultrasonic waves received;

an integrator circuit which performs charging of electric charge outputted from the receiver circuit and outputs a judgment voltage having a magnitude in accordance with an amount of electric charge charged;

a drive circuit which feeds the transmitter circuit with a drive signal for having the ultrasonic waves transmitted; and a control circuit which judges, based on the magnitude of the judgment voltage, whether or not multiple feeding has occurred, wherein the transmitter circuit and the receiver circuit are arranged opposite each other across the sheet conveyed, the control circuit changes a level of a transmission instruction signal to be sent to the drive circuit to a level instructing to start feeding of the drive signal to the transmitter circuit, and, at a lapse of a wait time after the level of the transmission instruction signal is changed to the level instructing to start feeding of the drive signal to the transmitter circuit, changes a level of a charging instruction signal to a level instructing to start execution of charging, in response to the level of the charging instruction signal changing to the level instructing to start execution of charging, the integrator circuit performs charging of an output of the receiver circuit during a charging time determined in advance, and when adjusting the wait time, the control circuit executes processing for adjustment a plurality of times, recognizes the magnitude of the judgment voltage in each execution of the processing for adjustment, makes the wait time different in each execution of the processing for adjustment, and determines a new wait time as the wait time based on the magnitude of the judgment voltage recognized in the processing for adjustment.

2. The sheet conveyance device according to claim 1, wherein, when adjusting the wait time, the control circuit determines the wait time in the processing for adjustment in which the judgment voltage is maximum as the new wait time.

3. The sheet conveyance device according to claim 1, further comprising:

a delay circuit which has one input and a plurality of outputs and in which a delay time of a signal fed thereto is different for each output; and a selection circuit to which the outputs of the delay circuit are fed and which outputs one of the outputs of the delay circuit as the charging instruction signal, wherein when adjusting the wait time, the control circuit feeds the transmission instruction signal to an input terminal of the delay circuit, the delay circuit delays the transmission instruction signal fed thereto and outputs a plurality of signals with different delay times, and the control circuit, in each execution of the processing for adjustment, makes the selection circuit switch an output of the delay circuit to be given to the integrator circuit.

4. The sheet conveyance device according to claim 3, wherein the delay circuit includes a plurality of branch circuits and a first buffer which delays a signal fed to the input terminal of the delay circuit, the plurality of branch circuits are connected in parallel to an output of the first buffer, the plurality of branch circuits each include one or a plurality of second buffers which delay a signal input thereto and each have a different number of the second buffers, in such a branch circuit of the branch circuits as includes a plurality of the second buffers, the second buffers are connected in series, and an output of a final-stage second buffer among the second buffers is fed to the selection circuit.

5. The sheet conveyance device according to claim 3, wherein when adjusting the wait time, the control circuit recognizes, among the plurality of outputs of the delay circuit, an output of the delay circuit with which the judgment voltage is maximum, and determines the new wait time by determining the recognized output of the delay circuit with which the judgment voltage is maximum as an output of the delay circuit to be given to the integral circuit.

6. The sheet conveyance device according to claim 1, wherein the control circuit adjusts the wait time at a time point for adjustment determined in advance, and judges whether or not multiple feeding has occurred by using the new wait time after adjusting the wait time until a next time point for adjustment.

7. The sheet conveyance device according to claim 1, wherein when a level of a discharging instruction signal from the control circuit changes to a level instructing to start execution of discharging, the integrator circuit discharges electric charge charged, and the control circuit changes the level of the discharging instruction signal to a level instructing to start execution of discharging before charging is started, and lowers the judgment voltage to zero before charging is started.

8. A method for controlling a sheet conveyance device, the method comprising:

transmitting ultrasonic waves from a transmitter circuit provided on a conveyance path for a sheet fed out by a sheet feed rotary body;

making a receiver circuit provided on the conveyance path for the sheet output an electric charge in accordance with intensity of the ultrasonic waves received;

using an integrator circuit to perform charging of electric charge outputted from the receiver circuit and to output a judgment voltage having a magnitude in accordance with an amount of electric charge charged;

using a drive circuit to feed the transmitter circuit with a drive signal for having the ultrasonic waves transmitted;

judging, based on the magnitude of the judgment voltage, whether or not multiple feeding has occurred;

arranging the transmitter circuit and the receiver circuit opposite each other across the sheet conveyed;

changing a level of a transmission instruction signal to a level instructing to start feeding of the drive signal to the transmitter circuit;

at a lapse of a wait time after the level of the transmission instruction signal is changed to the level instructing to start feeding of the drive signal to the transmitter circuit, changing a level of a charging instruction signal to a level instructing to start execution of charging;

in response to the level of the charging instruction signal changing to the level instructing to start execution of charging, making the integrator circuit perform charging of an output of the receiver circuit during a charging time determined in advance; and when adjusting the wait time, executing processing for adjustment a plurality of times, recognizing the magnitude of the judgment voltage in each execution of the processing for adjustment, making the wait time different in each execution of the processing for adjustment, and determining a new wait time as the wait time based on the magnitude of the judgment voltage recognized in the processing for adjustment.

* * * * *